United States Patent [19]

Wuerflein

[11] 4,317,040

[45] Feb. 23, 1982

[54] LOW RIPPLE REGULATED X-RAY TUBE POWER SUPPLY FILAMENT TRANSFORMER

[75] Inventor: Don E. Wuerflein, Mountain View, Calif.

[73] Assignee: Pennwalt Corporation, Philadelphia, Pa.

[21] Appl. No.: 242,097

[22] Filed: Mar. 9, 1981

Related U.S. Application Data

[63] Continuation-in-part of Ser. No. 168,479, Jul. 14, 1980.

[51] Int. Cl.[3] ..... H05G 1/30; H05G 1/10

[52] U.S. Cl. ..... 250/421; 250/409; 363/95; 336/182

[58] Field of Search ..... 250/421, 418, 409; 363/15, 21, 22, 74, 95; 315/308; 336/182

[56] References Cited

U.S. PATENT DOCUMENTS

| | | | |
|---|---|---|---|
| 2,600,057 | 6/1952 | Kerns | 336/182 |
| 2,655,623 | 10/1953 | Parker | 250/421 |
| 3,320,477 | 5/1967 | Boeker | 315/308 |
| 3,863,140 | 1/1975 | Easter et al. | 363/15 |
| 3,974,387 | 4/1976 | Brönner et al. | 250/409 |
| 4,076,996 | 2/1978 | Maehara et al. | 315/308 |
| 4,238,683 | 12/1980 | Baumann | 250/418 |
| 4,246,633 | 1/1981 | Borkovitz | 363/95 |

FOREIGN PATENT DOCUMENTS

| | | | |
|---|---|---|---|
| 2431171 | 2/1980 | France | 250/421 |
| 910420 | 11/1962 | United Kingdom | 250/421 |

*Primary Examiner*—Alfred E. Smith
*Assistant Examiner*—T. N. Grigsby

[57] ABSTRACT

A low ripple high voltage power supply and a filament transformer for use therewith in a dental X-ray system are disclosed. The power supply utilizes a rectifier and regulator circuit to provide a low voltage regulated DC signal, a DC-AC converter for providing a high-frequency chopped power signal suitable for efficient transformation to a high voltage, followed by a multiplier for generating the final high voltage signal to be applied to the X-ray tube. A high frequency clock circuit is used for driving the converter and also for controlling logic circuitry used to develop the regulator control signals. Both a voltage and a current control loop are utilized in the regulator control, and the tube anode current and filament current are controlled as a function of sensed anode current. The filament transformer is coaxially structured, employs a single turn secondary, and insures minimal high voltage stress areas within the tubehead of the X-ray system.

7 Claims, 6 Drawing Figures

J5-2
J5-1
HV TRANSF.
88
86
87
102
FILAMENT TRANSF.
81
83
82
84
66
60
64
62
50
75-2
75-3
75-4
75-5
75
75-1
61
63
99
101
57
56
AMP
156
+15
J4-6
J4-5
AMP
71
AMP
70
98
97
96
95
52
RECT.
+15V
TRANSF. & RECT.
J4-7
J4-8
53
OPTICAL COUPLER
93
92
AMP
51
POWER IN
+15V
90
91
J5-1

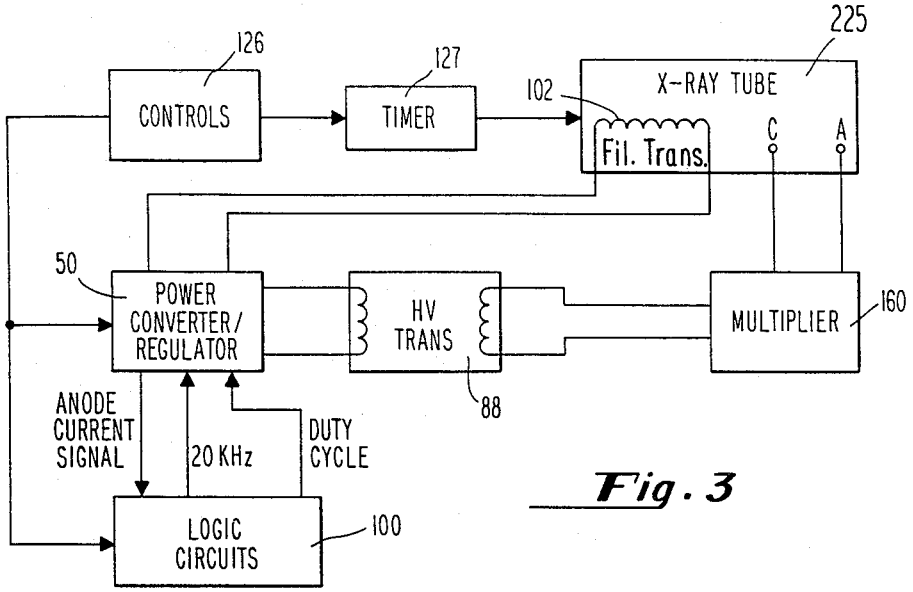
Fig. 3
Fig. 4
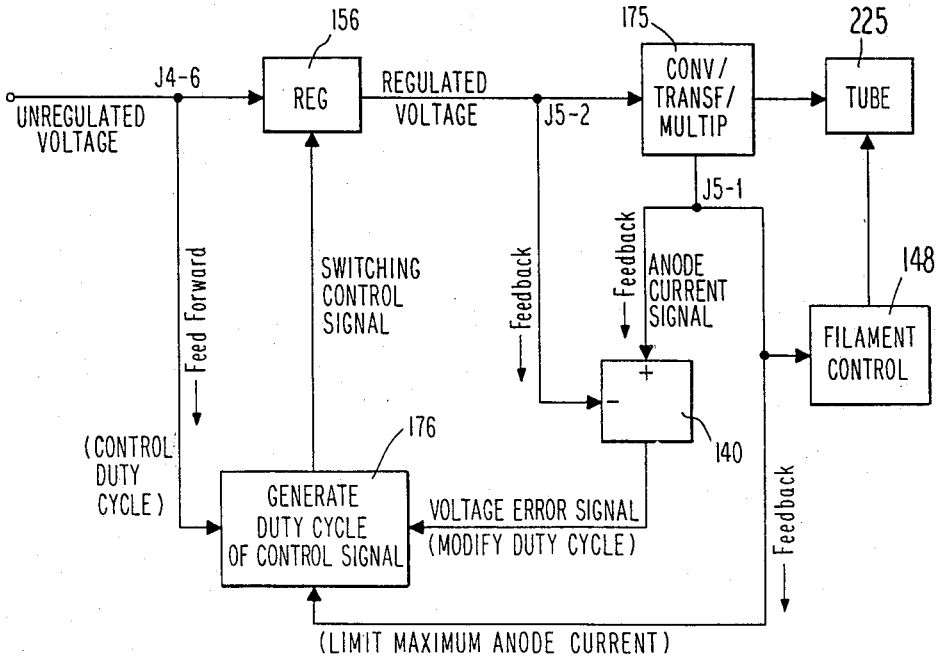

LOW RIPPLE REGULATED X-RAY TUBE POWER SUPPLY FILAMENT TRANSFORMER

The present application is a continuation-in-part of Application Ser. No. 168,479, filed July 14, 1980, for "Low Ripple Regulated X-Ray Tube Power Supply" of Don E. Wuerflein, assigned to the assignee hereof.

BACKGROUND OF THE INVENTION

This invention lies in the field of low ripple regulated power supply systems and, more particularly power supply systems for supplying high voltage X-ray tubes such as those used in dental applications.

DESCRIPTION OF THE PRIOR ART

Power supply systems for use in dental applications must meet a number of very specific design criteria. First, it is very desirable that the power supply be low weight, and be easily packaged in a small housing. This means that the design must avoid use of heavy transformer elements, to the extent possible. It is also necessary to design a system which avoids any substantial heat problem, and which avoids corona breakdown. It is very desirable that the power supply have as low a ripple as possible. A substantial ripple delivered to the X-ray tube causes a variation of the energy delivered by the X-ray tube, and thus a variation of the generated X-ray frequency. In order to concentrate the delivered X-rays at the desired high frequency, it is necessary to reduce ripple as much as possible. To the extent that X-ray energy can be concentrated at the desired peak level, the X-ray penetration can be increased substantially for the same given power input, thus effectively increasing the efficiency of the system. It is also to be noted that an X-ray tube is not, through its life time, a constant impedance device, and thus there is a need for the power supply to provide effective current control as well as voltage control. Further, it is essential in an X-ray tubehead for dental applications that no high voltage stress areas be produced by the filament transformer.

In the prior art most dental system power supplies provide transformation to high voltage at either the given 50–60 Hz input, or at a relatively low frequency. See, for example, U.S. Pat. No. 4,167,670, which utilizes an 800 Hz signal which is passed through a high voltage transformer. It has been found that greatly increased efficiency can be obtained by utilizing much higher frequencies.

There is a great need in the art for a light weight power supply for dental systems, producing both voltage and current controlled power at low ripple for efficient X-ray tube operation. This can be achieved by utilization of a relatively high frequency power signal, e.g. 20 KHz, and the utilization of both feedforward and feedback control loops to provide a fast response voltage regulation.

SUMMARY OF THE INVENTION

There is provided a low ripple high voltage regulated power supply for generating a controlled DC voltage on the order of 70 kVp for use in a dental X-ray system, comprising a regulator circuit controlled by a variable duty cycle high frequency control signal, the frequency preferably being above 10 KHz and suitably in the area of 40 KHz rate to provide for efficient transformer boosting to a high voltage on the order of 6,000 volts.

An electronic multiplier is used to boost the voltage to the final desired level for X-ray tube operation. The regulator control comprises a sube anode current feedback control loop based upon a derived signal representative of anode current; a feedforward voltage control for controlling regulation as a function of unregulated voltage; and a feedback control loop for controlling regulation as a function of the regulated voltage. The power supply control provides for a minimum anode current, a limit on the maximum anode current, and control of anode current at a selectable reference value between the minimum and maximum levels. The X-ray tube anode current is controlled as a function of detected X-ray tube anode current. An improved filament transformer insures the absence of high voltage breakdown and stress areas.

BRIEF DESCRIPTION OF THE DRAWINGS

FIG. 3 is a block diaagram showing the major components of the dental X-ray system of this invention.

FIG. 4 is a block diagram showing the control loops for controlling the voltage and current delivered to the X-ray tube by the power supply of this invention.

DESCRIPTION OF THE PREFERRED EMBODIMENT

Figure 1:
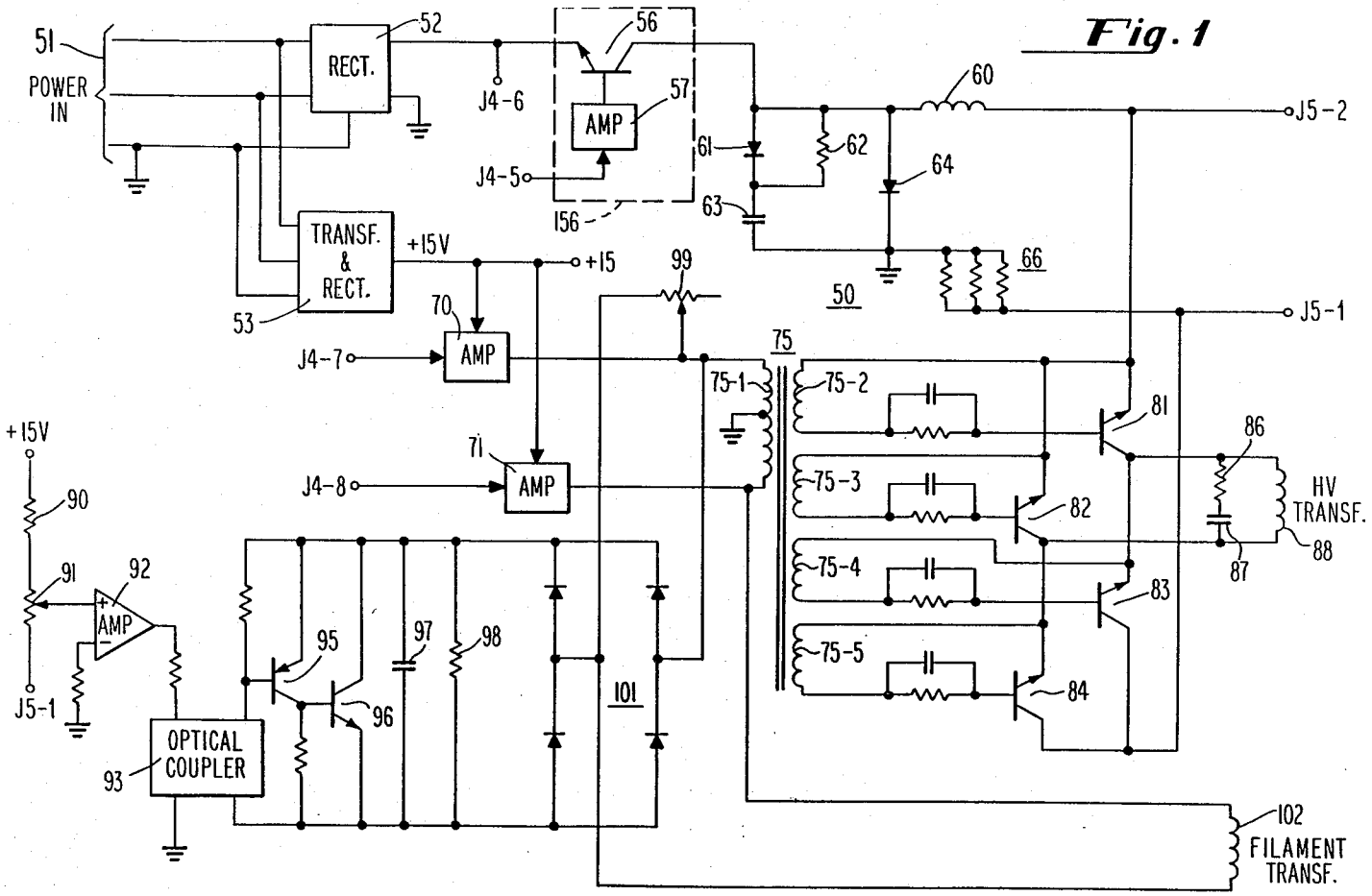
FIG. 1 is a circuit diagram of a portion of the power supply of this invention, including the regulator and converter circuitry.
Figure 2:
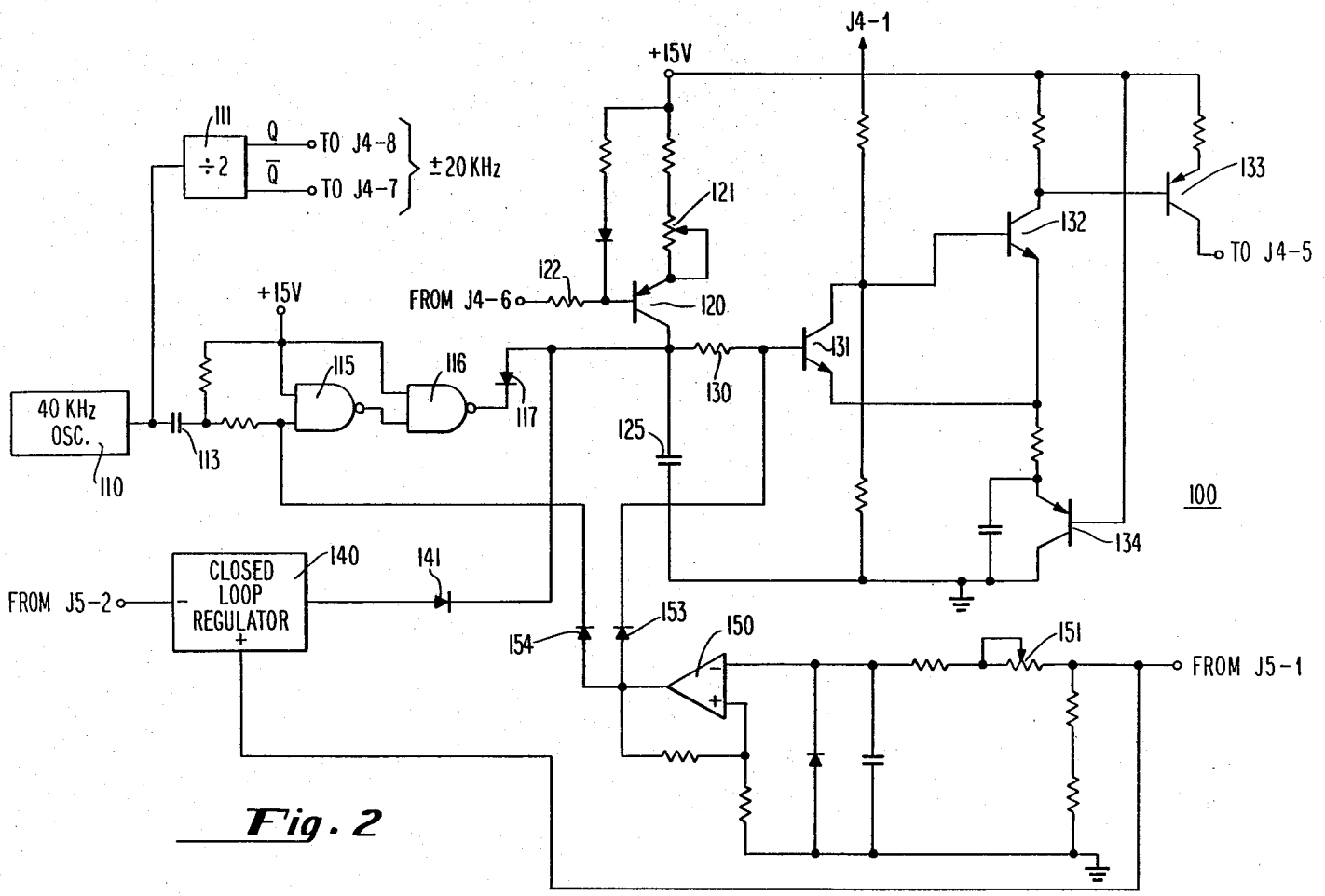
FIG. 2 is a circuit diagram of the logic circuitry portion of the power supply of this invention.

Referring now to the drawings, there is presented a description of a preferred embodiment of the circuitry of this invention. In FIGS. 1 and 2, certain conventionally employed elements, such as resistors, capacitors and diodes, are not given numeral designations and are not included in the description, since it is clear to one of ordinary skill in the art how they are incorporated into the circuit design.

Referring now to FIG. 1, which illustrates the converter-regulator 50, the AC power input is shown at the upper left hand corner of the drawings, connected to a rectifier 52, of conventional diode form, providing an unregulated DC output of approximately −250 volts at terminal J4-6. The AC power input 51 is also connected to a transformer and rectifier circuit, shown in block 53, to provide −15 volt supply which is used for powering the electronic circuitry.

The unregulated voltage is regulated through switching transistor 56, which acts as an on-off switch. Switching transistor 56 is driven closed or open by the output of amplifier 57, which output is connected through to the base of switching transistor 56. Amplifier 57 receives at its input a 40 KHz pulse wave signal from terminal J4-5, which signal has a variable duty cycle. The details of generation of the variable duty cycle control signal, which controls the amount of regulation provided by switching transistor 56, are set forth below in the discussion of the logic circuitry illustrated in FIG. 2.

The output of switching transistor 56, being the collector of the transistor, is connected through an inductor 60 to terminal J5-2. Since switching transistor 56 turns on and off at a controlled duty cycle, it produces a chopped DC output. The inductor 60 averages this chopped DC to reduce the ripple. The output of switching transistor 56 is also connected to ground through diode 64, and through the parallel combination of diode 61 and resistor 62 in series with capacitor 63. Three one ohm resistors in parallel, illustrated at 66, are connected between ground and terminal J5-1, and are used to sense the amount of current flow at the output of the regulator, which is a measure of the current delivered to the X-ray tube, i.e., the tube anode current.

Directing attention to the center of FIG. 1, terminals J4-7 and J4-8 receive 20 KHz signals which are 180° out of phase. These signals are amplified at amplifiers 70 and 71 respectively, and outputted across the primary winding 75-1 of transformer 75. Four secondary windings, 75-2 through 75-5 are shown driving a converter comprised of transistors 81,82,83 and 84. The imput to the converter is provided by the regulated voltage between terminals J5-1 and J5-2, and the output is taken at the collectors of transistors 81 and 82 respectively. The converter, driven at 20 KHz through transformer 75, operates in a well known fashion to chop up the regulated DC, and provide a 20 KHz output signal of approximately 200 volts AC across the series combination of resistor 86 and capacitor 87. This output is connected to the input of high voltage transformer 88, which at the 20 KHz frequency, provides efficient transformation to a voltage level of about 6,000 volts. The output of the high voltage transformer is connected to multiplier 160 seen in FIG. 3, to provide the 70 kVp power for the X-ray tube, as is discussed further in connection with FIG. 3.

Still referring to FIG. 1, the current sense signal at J5-1 is inputted to a center tapped resistor 91 which is connected in series through resistor 90 to the 15 volt supply source, as seen in the lower left hand corner of the Figure. The adjustable contact of resistor 91 is inputted to the positive terminal of differential amplifier 92, the negative terminal being connected through a resistor to ground. By adjustment of the contact terminal at resistor 91, a current reference, or threshold is achieved and when the current level J5-1 rises above the reference level, amplifier 92 provides an output. The current output from amplifier 92 is coupled through optical coupler 93 to the base of transistor 95, which couples an amplified signal to transistor 96. Note that when transistor 96 is driven to the "on" conducting condition, it provides an essential short circuit across its terminals. This provides a switchable shunt circuit which affects the current through filament transformer 102, later described, in the following manner.

The 20 KHz signal across winding 75-1 is connected across the series combination of filament transformer 102 and variable resistor 99. Resistor 99 in turn is shunted by diode bridge 101, which provides a rectified output signal across capacitor 97 and resistor 98, whereby capacitor 97 is normally maintained at a substantially constant voltage level. As long as transistor 96 is non-conducting, bridge 101 does not provide a short circuit shunt of resistor 99. However, when there is an output from amplifier 92, transistor 96 provides a closed circuit, causing the bridge diodes to conduct in series, thereby effectively creating a short circuit path shunting resistor 99.

It is to be noted that resistor 99 constitutes the maximum resistance that is in the series loop with the filament transformer 102, and thus the adjustment of resistor 99 sets the minimum filament current. Note further that the contact arm of resistor 91 is connected to the positive input terminal of differential amplifier 92. Thus, as the current sense signal at J5-1 increases in negative value, corresponding to an increased X-ray tube current, the output of amplifier 92 turns off, thus switching transistor 96 to an off state and eliminating the diode shunt. This causes the minimum filament current to flow in the filament transformer 102. Conversely, if the X-ray tube current drops such that the signal developed at resistor 91 rises sufficiently to turn transistor 96 on, then resistor 99 is shunted and increased current flows through filament transformer 102. Thus resistor 99 sets the minimum current, and the setting at resistor 91 establishes the current threshold or breakpoint for controlling tube current at a level above the minimum. As is seen further in the discussion of the circuitry of FIG. 2, provision is also made for setting an upper or maximum limit to the X-ray tube current.

Referring now to FIG. 2, there is shown in detail a circuit diagram of the primary components of the logic circuitry 100, which is involved in both the voltage control loop and the current control loop of the power supply of this invention. A 40 KHz oscillator is shown at block 110, which provides an output which is passed through a divide-by-two circuit 111, providing complementary 20 KHz signals at terminals J4-7 and J4-8. These signals are coupled to the inputs of amplifier 70 and 71 respectively as illustrated in FIG. 1, providing the 20 KHz signals for driving the converter. The 40 KHz oscillator output is also coupled through capacitor 113 to a first NAND gate 115, the output of which is coupled to one of the input terminals of a second NAND gate 116. Gates 115 and 116 each have a second input terminal connected to the 15 volt supply, which provides the logic high level. The 40 $KH_3$ signal at the ouptut of gate 116 is connected through diode 117 to capacitor 125, such that whenever the logic signal at the output of gate 116 goes low, capacitor 125 is discharged to the logic low level. As is discussed further below, a connection from amplifier 150 to gate 115 establishes the logic low level under certain conditions.

Capacitor 125 is normally charged through transistor 120, which is connected to the 15 volt supply through adjustable resistor 121 as shown. The combination of transistor 120 and resistor 121 connected to the voltage supply constitutes a current source which operates at a level controlled by the signal on the base of transistor 120. As illustrated, the base signal is provided from terminal J4-6 through resistor 122. The voltage at J4-6 is the unregulated voltage, typically about −200 volts, and is connected through resistor 122 which is suitably a 1 MEG resistor. Thus the current which charges capacitor 125 charges toward the 15 volt level until it is discharged by the logic low level of the 40 KHz signal transmitted through gate 116. Thus, the voltage level of capacitor 125 is held low for about a micro-second, and then rises at a rate determined by the unregulated voltage signal from terminal J4-6.

The voltage level on capacitor 125 is coupled through resistor 130 to the input stage 131 of a conventional trigger circuit comprising transistors 131,132 and 134. The collector of transistor 131 and base of transistor 132 are connected through a resistor to terminal J4-1, which is at about 15 volts whenever the tube is on. As long as the voltage level of capacitor 125 is below the trigger level, transistor 131 is non-conducting, such that transistor 132 conducts through transistor 134. The collector terminal of transistor 132 is connected to the base of transistor 133, providing a high output which is connected to terminal J4-5. As soon as the voltage across capacitor 125 rises to the trigger level, transistor 131 is caused to conduct, shunting the base to emitter terminals of transistor 132 and turning it off, thereby taking transistor 133 out of conduction and dropping the output at J4-5. Thus, the sooner the voltage on capacitor 125 rises to the trigger level, the sooner the 40 KHz output at J4-5 drops to logic low. Thus, the voltage level on capacitor 125 controls the duty cycle of the control signal at J4-5, which (as shown in FIG. 1) is amplified at 57 and connected to the base terminal of switching transistor 56. The greater the percentage of time that the 40 KHz signal applied to the base of switching transistor 56 is negative, the greater the amount of time that it is off and thus the lower is the magnitude of the regulated negative voltage that is provided at the collector of switching transitor 56. The greater the magnitude of unregulated voltage at J4-6, the more current is provided through transistor 120, and the sooner capacitor 125 rises in voltage to the trigger level. Thus, as the unregulated voltage increases in magnitude, the off portion of the control signal to switching transistor 56 increases, thus providing a corresponding decrease in the regulated voltage output; the lower the unregulated voltage at J4-6, the slower the charging of capacitor 125, and the less time that switching transistor 56 is turned off, thereby increasing the regulated voltage.

The duty cycle of the signal J4-5 is modified both by a voltage signal from J5-2, and by the current signal from J5-1. The regulated voltage signal developed at J5-2 is connected to the negative terminal of closed loop regulator 140. The positive input terminal of regulator 140 is connected through to the current signal developed at J5-1. Regulator 140 is suitably a conventional chip or IC comprising a differential or comparator amplifier, suitably biased to provide an output at a predetermined reference level of the J5-2 signal. This reference level may be adjusted by an adjustable resistor connected to the negative input terminal, not shown. The output of the comparator is suitably inputted to an amplifier (not shown) in regulator 140 which provides a regulated positive output when the voltage input signal exceeds the referenced current signal by the set amount. The output of regulator 140 is connected through diode 141, thereby charging capacitor 125 to the threshold of the trigger circuit whenever the voltage at J5-2 exceeds the reference. Thus, by increasing the charge current at capactior 125 at a higher level than normal, capacitor 125 reaches the trigger threshold sooner, thus lowering the output voltage. Thus, when the regulated voltage level at J5-2 exceds the set point established in circuit 140, the duty cycle of the switching control signal is adjusted to cause greater regulation, thus tending to reduce the level of the regulated voltage.

The current signal from J5-1 is also inputted through variable resistor 151 to the negative terminal of differential amplifier 150. The positive terminal of amplifier 150 is connected through a suitable resistor to ground. Adjustable resistor 151 is set to provide the current limit, or maximum current provided from differential amplifier 150, which is connected through diode 154 to one of the input terminals of gate 115. This disables the capacitor 125 through discharge circuit 116, 117. The output from amplifier 150 may also suitably be connected through diode 153 directly to the base terminal of transistor 131, thus providing an off signal at J4-5. The control signal developed at J4-5 is modified to provide increased regulation, thereby limiting the amount of current provided through to the tube.

Referring now to FIGS. 3 and 4, the incorporation of the power supply of this invention into an X-ray tube control system is illustrated. Suitable controls 126 are used to provide control signals to a timer 127 as well as to the power converter regulator 50 of FIG. 1 and the logic circuits 100 of FIG. 2. The timer 127 provides timing signals for turning the X-ray tube 225 on and off for suitable periods of time, as desired. The power converter/regulator circuit 50 provides a controlled current to the filament of transformer 102, thus controlling the filament current in the X-ray tube. The output of circuit 50 is connected through high voltage transformer 88 to provide an approximately 6,000 volt input to multiplier 160. Multiplier 160 is suitably a Cockroft-Walton type multiplier and provides an output of about 70,000 volts peak. This output voltage is supplied across the cathode and anode of the X-Ray tube. Thus tube 225 is dontrolled both in terms of voltage applied across the tube and the current supplied to its filament.

In FIG. 4, there is shown a block diagram which outlines the control circuits of this invention. As illustrated, the unregulated voltage at terminal J4-6 is regulated at regulator 156, the main element of which is transistor 56. The unregulated signal is also inputted as a feedforward to block 176, to control the duty cycle of the switching control signal which is connected to the regulator 156. Referring to logic circuit 100 which is shown in FIG. 2, block 176 comprises primarily the current source 120, 121 which charges capacitor 125, the current source being controlled by the unregulated voltage signal from terminal J4-6. The trigger circuit 131,132,143 (seen in FIG. 2) is also included in block 176 illustrated in FIG. 4. The regulator 156 is also controlled by a feedback loop where the regulated voltage signal at J5-2 is compared in closed loop regulator 140 with the anode current signal developed at terminal J5-1, to produce a voltage error signal which is introduced at block 176 to modify the duty cycle. As seen in FIG. 2 and noted hereinabove, the output of block 140 produces a signal which changes the charge current provided to capacitor and adjusting the duty cycle accordingly. A third input to block 176 is provided from the current sense feedback signal at J5-1 to limit the maximum anode current. As seen in FIG. 2, this is the feedback path through variable resistor 151 and amplifier 150.

The control loop for controlling the current of the X-ray tube filament is also shown in FIG. 4. The anode current signal from terminal J5-1 is connected through to the filament control circuit 148, which comprises the controlled diode shunt 101 and the variable resistor 99. This loop establishes the minimum filament current by the setting of resistor 99, and controls the filament current at a level above the minimum, (e.g. 9 ma) by the closed loop action. Additionally, when the anode current exceeds the predetermined limit, the voltage loop acts to reduce voltage across the tube, thereby also limiting tube anode current. The regulated DC voltage is converted to 20,000 cycle AC square wave voltage at block 175.

Figure 5:
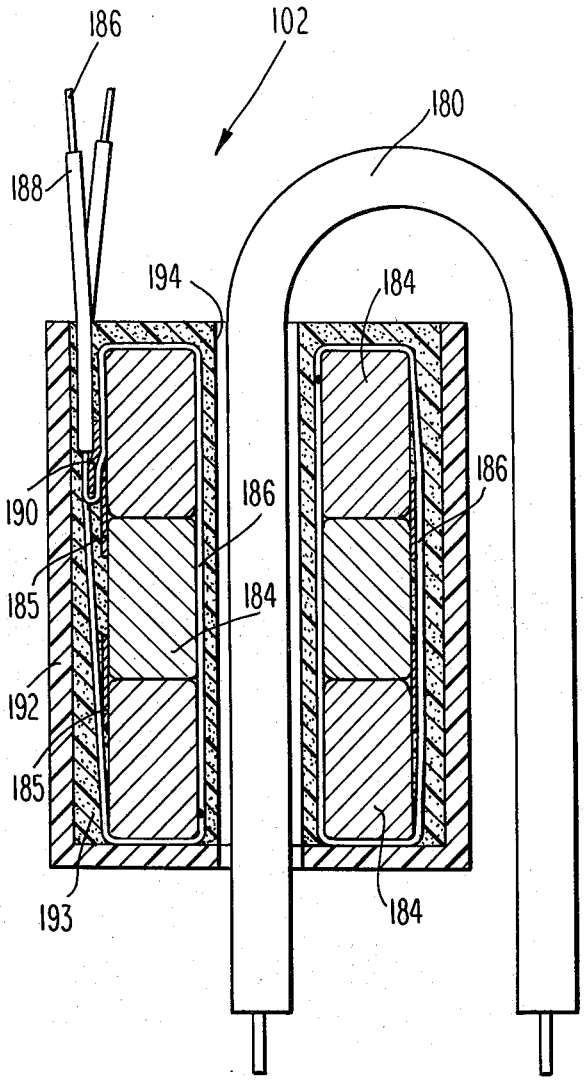
FIG. 5 is a sectional view of the filament transformer of this invention shown in the circuit and block diagrams of FIGS. 1 and 3 respectively.
Figure 6:
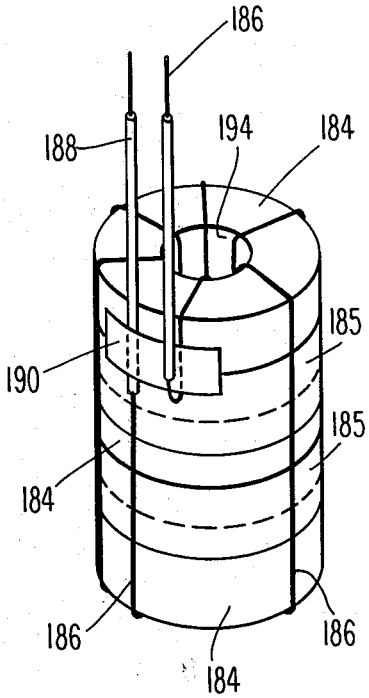
FIG. 6 is a perspective view of the primary or wound toroid assembly of FIG. 5.

Referring now to FIGS. 5 and 6, filament transformer 102 of X-ray tube 225 is coaxially structured and includes an insulated single turn secondary 180 as its center conductor with the primary/core assembly functioning as an outer shell. The transformer provides minimum voltage stress between the primary and secondary. The absence of stress areas is essential at the high voltages employed in the presently described tubehead, i.e., approaching 70,000 volts, if accurate and consistently reproducible portrayals of the dental arch and temperomandibular joint area are to be obtained.

The primary comprises a plurality of stacked ferrite toroids 184, three being employed in the embodiment shown. The toroids have a permeability of 10,000 and the filament transformer provides an output of 4 volts at 20 KHz. The invention is not intended to be limited to the use of ferrite toroids. Tape wound 50% niclel toroids, for example, work satisfactorily but at a higher cost, or a single ferrite core approximating the size of the stacked toroids may be used, and the like.

In assembling the filament transformer 102, stacked toroids 184 are held together for convenience of handling with mylar tape 185, for example, a polyester film product of duPont. Six turns of a length of #20 wire 186 are wound tightly around the stacked toroids, each turn passing through the central holes thereof with minimum bowing of the wire throughout. Each end of wire 186 is threaded into a thin walled polytetrafluoroethylene sleeve 188 having a diameter substantially identical with the wire. A small piece of mylar tape 190 holds sleeves 188 against the taped toroids. The sleeved wires extend from the toroids as shown clearly in FIG. 6.

The wound toroid assembly is then carefully positioned in a suitable potting cup 192. Epoxy 193 may now be poured over the assembly and the entire potted assembly de-aired. De-airing causes shrinkage of the epoxy material, requiring the potting cup to be filled again with epoxy to a level which covers the toroid assembly. The assembly is de-aired a second time. Epoxy is again added to the cup to bring the epoxy level to the top thereof after which the assembly is cured at 100° C. for about 3 hours.

Axial hole 194 is drilled through the assembly without exposing wire 186, or hole 194 may be provided prior to the final de-airing step.

Single turn secondary 180 is inserted through hole 194. Ends of secondary 180 are connected to the X-ray tube filament. As shown in FIG. 1 ends of wire 186 of filament transformer 102 are connected to the power supply.

It is thus seen that there is provided a power supply with both voltage and current loops, for very efficient regulation of the voltage delivered by the power supply to the X-ray tube. While the illustrated frequency of the control signals for switching the regulator switch 56, and for driving the converter 81–84, are illustrated as 40 KHz and 20 KHz, the invention comprises utilizing control signals with high frequency rates, preferably above 10 KHz. The high frequency as used in this invention provides efficient transformation at high voltage transformer 88, with relatively little voltage wave distortion through the transformer at the high frequency. Also, the use of the high frequency control signal in the regulator circuit permits very fast response time, thus contributing to the low ripple voltage which is obtained with the power supply of this invention. By utilizing both a feedforward signal and a feedback signal for voltage regulation, additional efficiency is obtained. By controlling current delivered to the tube, allowance is made for the fact that the tube impedance, as seen by the power supply, is not constant and varies with the life time of the tube itself. It is to be noted that the current control signal developed at terminal J5-1 is representative of the current actually delivered to the tube, with the assumption that the losses introduced in high voltage transformer 88 and multiplier 160 are negligible. Likewise the signal developed at terminal J5-2, the regulated voltage feedback signal, is different from the voltage actually delivered to the X-ray tube only by a factor made up of the high voltage transformer turns ratio and the multiplier gain, and is thus representative of delivered voltage. The filament transformer of this invention was specially constructed for use with the low ripple high voltage power supply disclosed above in order that high voltage stress areas and breakdown would be held to an absolute minimum.

I claim:

1. In an X-ray tubehead having a filament transformer associated therewith, said tubehead supplied by a low ripple, high voltage power supply adapted to receive an unregulated input and to deliver a regulated output adapted to supply power to a load connected across the output of said supply, said power supply comprising (a) a regulator circuit providing regulation under control of a control signal imputted thereto;

(b) control signal generating means for generating said control signal and inputting same to said regulator circuit;

(c) means for developing a signal representative of said unregulated input and connecting said unregulated input signal to said control signal generating means;

(d) means for developing a signal representative of said regulated output and connecting same to said control signal generating means; and (e) said control signal generating means having means responsive to both of said representative signals for generating said control signal as a function to both of said representative signals, in combination therewith, the improvement to said filament transformer for providing minimal high voltage stress areas and negligible high voltage breakdown, said filament transformer comprising a coaxial structure having a single turn secondary.

2. Apparatus of claim 1 wherein primary of said transformer comprises a plurality of stacked ferrite toroids.

3. Apparatus of claim 2 wherein said primary comprises 3 ferrite toroids.

4. Apparatus of claim 3 wherein said stacked toroids have a permeability of 10,000 and said transformer provides an output of 4 volts at 20 KHz.

5. Apparatus of claim 1 wherein primary of said transformer is a tape wound 50% nickel toroid.

6. Apparatus of claim 1 wherein primary of said transformer is a single ferrite toroid.

7. Apparatus of claims 5 or 6 wherein said transformer provides an output of 4 volts at 20 KHz.

* * * * *